US007874281B2

(12) United States Patent
Delp et al.

(10) Patent No.: US 7,874,281 B2
(45) Date of Patent: Jan. 25, 2011

(54) METHOD AND DEVICE FOR OPERATING AN INTERNAL COMBUSTION ENGINE

(75) Inventors: Matthias Delp, Bad Abbach (DE); Gerhard Eser, Hemau (DE)

(73) Assignee: Continental Automotive GmbH, Hannover (DE)

( * ) Notice: Subject to any disclaimer, the term of this patent is extended or adjusted under 35 U.S.C. 154(b) by 64 days.

(21) Appl. No.: 12/307,383

(22) PCT Filed: May 21, 2007

(86) PCT No.: PCT/EP2007/054893

§ 371 (c)(1),
(2), (4) Date: Jun. 3, 2009

(87) PCT Pub. No.: WO2008/003550

PCT Pub. Date: Jan. 10, 2008

(65) Prior Publication Data

US 2009/0320795 A1 Dec. 31, 2009

(30) Foreign Application Priority Data

Jul. 7, 2006 (DE) ..... 10 2006 031 569

(51) Int. Cl.
*F02M 57/02* (2006.01)
*G01M 19/00* (2006.01)

(52) U.S. Cl. ..... 123/446; 73/114.26

(58) Field of Classification Search ..... 123/509, 123/446, 447; 73/114.26, 114.27
See application file for complete search history.

(56) References Cited

U.S. PATENT DOCUMENTS

| | | | | |
|---|---|---|---|---|
| 4,870,587 | A * | 9/1989 | Kumagai | 701/110 |
| 5,402,675 | A * | 4/1995 | Entenmann et al. | 73/114.07 |
| 5,417,194 | A * | 5/1995 | Augustin | 123/456 |
| 5,970,784 | A * | 10/1999 | Genin | 73/114.27 |
| 6,484,691 | B1 | 11/2002 | Schuster et al. | 123/305 |
| 6,691,024 | B2 | 2/2004 | Kunz | 701/114 |
| 6,732,714 | B2 * | 5/2004 | Frenz et al. | 123/479 |
| 6,804,997 | B1 | 10/2004 | Schwulst | 73/118.2 |

(Continued)

FOREIGN PATENT DOCUMENTS

DE 41 41 713 A1 6/1993

(Continued)

OTHER PUBLICATIONS

Written Opinion of the International Searching Authority (Supplementary Sheet) for PCT/EP2007/054893, 1 page, Apr. 2005.

*Primary Examiner*—Thomas N Moulis
(74) *Attorney, Agent, or Firm*—King & Spalding L.L.P.

(57) ABSTRACT

In a method and a device for operating an internal combustion engine with a fuel pump, which on the drive side is coupled with a camshaft or a crankshaft, and a fuel accumulator, which is supplied by the fuel pump and to which a pressure sensor is assigned for sensing the pressure in the fuel accumulator, to each cycle of the internal combustion engine a first and a second crankshaft rotation (CRK_R1, CRK_R2) are assigned. Depending on a signal sequence (P_F_S) of the sensed pressure in the fuel accumulator which is characteristic of the respective crankshaft rotation it is ascertained whether the crankshaft is in its first or second rotation (CRK_R1, CRK_R2).

20 Claims, 5 Drawing Sheets

U.S. PATENT DOCUMENTS

| | | | | |
|---|---|---|---|---|
| 6,871,633 | B1 * | 3/2005 | Date et al. | 123/447 |
| 7,392,790 | B2 * | 7/2008 | Shafer et al. | 123/446 |
| 7,624,712 | B1 * | 12/2009 | Pursifull | 123/179.4 |
| 7,726,284 | B2 * | 6/2010 | Hori | 123/501 |
| 7,789,068 | B2 * | 9/2010 | Serra et al. | 123/446 |
| 2002/0112683 | A1 | 8/2002 | Kunz | 123/90.15 |
| 2010/0180863 | A1 * | 7/2010 | Gwidt et al. | 123/357 |

FOREIGN PATENT DOCUMENTS

| | | | |
|---|---|---|---|
| DE | 199 34 112 | A1 | 1/2001 |
| DE | 101 08 055 | C1 | 8/2002 |
| DE | 101 15 262 | A1 | 10/2002 |
| WO | WO 01/86131 | A1 | 11/2001 |

* cited by examiner

METHOD AND DEVICE FOR OPERATING AN INTERNAL COMBUSTION ENGINE

CROSS-REFERENCE TO RELATED APPLICATIONS

This application is a U.S. National Stage Application of International Application No. PCT/EP2007/054893 filed May 21, 2007, which designates the United States of America, and claims priority to German Application No. 10 2006 031 569.3 filed Jul. 7, 2006, the contents of which are hereby incorporated by reference in their entirety.

TECHNICAL FIELD

The invention relates to a method and a device for operating an internal combustion engine with a fuel pump, which on the drive side is coupled with a camshaft, and a fuel accumulator, which is supplied by a fuel pump and to which a pressure sensor is assigned for sensing the pressure in the fuel accumulator.

BACKGROUND

Internal combustion engines have a crankshaft and a camshaft coupled with the crankshaft. One cycle of a four-stroke internal combustion engine comprises the aspiration, compression, expansion and expulsion strokes. One cycle of a four-stroke internal combustion engine requires 720 degrees of crankshaft angle and therefore a first and a second rotation of the crankshaft. To sense the crankshaft angle, incremental position sensors are very frequently used which for example comprise a pickup wheel configured as a toothed wheel with a specified number of teeth and a sensor element whose measurement signal is for example representative of the respective teeth. Such sensor elements are for example sensors which function according to the Hall principle.

To establish a reference position of the crankshaft, the pickup wheel typically exhibits an enlarged gap between two teeth. Solely on the basis of the measurement signal from the crankshaft angle sensor it is not possible to draw a conclusion as to which rotation the crankshaft is performing within the respective cycle, but this information is essential for operating the internal combustion engine.

To determine which of the two crankshaft angle rotations the internal combustion engine is performing within a cycle, a camshaft angle sensor can for example be used.

In addition, it is known that adjustment devices can be provided in a specified position of the crankshaft for adjusting a phase between a reference mark on the crankshaft and a reference mark on the camshaft. For example, from DE 101 08 055 C1 a method is known for determining the phase position of a camshaft in relation to a crankshaft in which the phase position is determined according to the camshaft angle sensed and the crankshaft angle sensed.

From DE 199 34 112 A1 it is known that a pressure in a fuel rail can be sensed by means of a pressure sensor. It is also known from DE 199 34 112 A1 that if the phase position of ignition and injection is wrong by 360 degrees of crankshaft when starting, fuel will be blown back into an affected injection valve by compression counterpressure. This leads to an increase in pressure in the fuel rail, which is sensed by the pressure sensor. An analog/digital comparator switch is provided, by means of which such a signal can be assessed. Depending on the signal thus assessed, ignition and injection are re-synchronized by 360 degrees of crankshaft.

From DE 101 15 262 A1 it is known that when a single-cylinder fuel pump of an internal combustion engine is used, a characteristic increase in pressure is to be observed once per rotation of the camshaft. Given the rigid coupling between the fuel pump and the camshaft, the camshaft position can be determined on the basis of the point in time at which the increase in pressure starts.

SUMMARY

According to various embodiments, a method and a device for operating an internal combustion engine can be created which are simple and reliable.

According to an embodiment, a method for operating an internal combustion engine with a fuel pump, which on the drive side is coupled with a camshaft or a crankshaft, and a fuel accumulator, which is supplied by the fuel pump and to which a pressure sensor is assigned for sensing the pressure in the fuel accumulator, whereby each cycle of the internal combustion engine is assigned a first and a second crankshaft rotation, may comprise the steps of: —depending on a signal sequence of the sensed pressure in the fuel accumulator which is characteristic of the respective crankshaft rotation ascertaining whether the crankshaft is in its first or second rotation, wherein a threshold value is determined depending on a variable which is characteristic of a fluid temperature, —depending on the signal sequence, determining a characteristic value, and —depending on a comparison of a characteristic value with the specified threshold value, ascertaining whether the crankshaft is in its first or second rotation.

According to a further embodiment, the signal sequence of the sensed pressure in the fuel accumulator which is characteristic of the respective crankshaft rotation can be sensed in order to ascertain whether the crankshaft is in its first or second rotation while an operating phase of the internal combustion engine takes place in which the pressure in the fuel accumulator increases. According to a further embodiment, the signal sequence of the sensed pressure in the fuel accumulator which is characteristic of the respective crankshaft rotation can be sensed in order to ascertain whether the crankshaft is in its first or second rotation near to the time when the internal combustion engine is started. According to a further embodiment, in at least one cycle of the internal combustion engine, before the signal sequence of the sensed pressure in the fuel accumulator which is characteristic of the respective crankshaft rotation is sensed in order to ascertain whether the crankshaft is in its first or second rotation the pressure in the fuel accumulator can be reduced. According to a further embodiment, before the signal sequence of the sensed pressure in the fuel accumulator which is characteristic of the respective crankshaft rotation is sensed in order to ascertain whether the crankshaft is in its first or second rotation an adjustment drive for adjusting a phase of the camshaft relative to the crankshaft can be controlled into a reference position. According to a further embodiment, within a specified crankshaft angle window relative to in each case one rotation of the crankshaft depending on the signal sequence of the sensed pressure in the fuel accumulator it can be ascertained whether the crankshaft is in its first or second rotation. According to a further embodiment, by referring to a reference angle after a specified period of time within a specified time window relative to in each case one rotation of the crankshaft depending on the signal sequence of the sensed pressure in the fuel accumulator it is ascertained whether the crankshaft is in its first or second rotation.

According to another embodiment, a device for operating an internal combustion engine with a fuel pump, which on the drive side is coupled with a camshaft or a crankshaft, and a fuel accumulator, which is supplied by the fuel pump and to which a pressure sensor is assigned for sensing the pressure in the fuel accumulator, wherein to each cycle of the internal combustion engine a first and a second crankshaft rotation is assigned, may be operable to —determine a threshold value depending on a variable which is characteristic of a fluid temperature, —determine a characteristic value depending on a signal sequence of the sensed pressure in the fuel accumulator which is characteristic of the respective crankshaft rotation, —ascertain whether a crankshaft is in its first or second rotation depending on a comparison of the characteristic value with the specified threshold value, and —to ascertain whether the crankshaft is in its first or second rotation depending on a signal sequence of the sensed pressure in the fuel accumulator which is characteristic of the respective crankshaft rotation.

BRIEF DESCRIPTION OF THE DRAWINGS

Exemplary embodiments are explained in more detail below with reference to schematic drawings.

Elements of the same construction or function are indicated with the same reference numbers across the figures.

DETAILED DESCRIPTION

Figure 1:
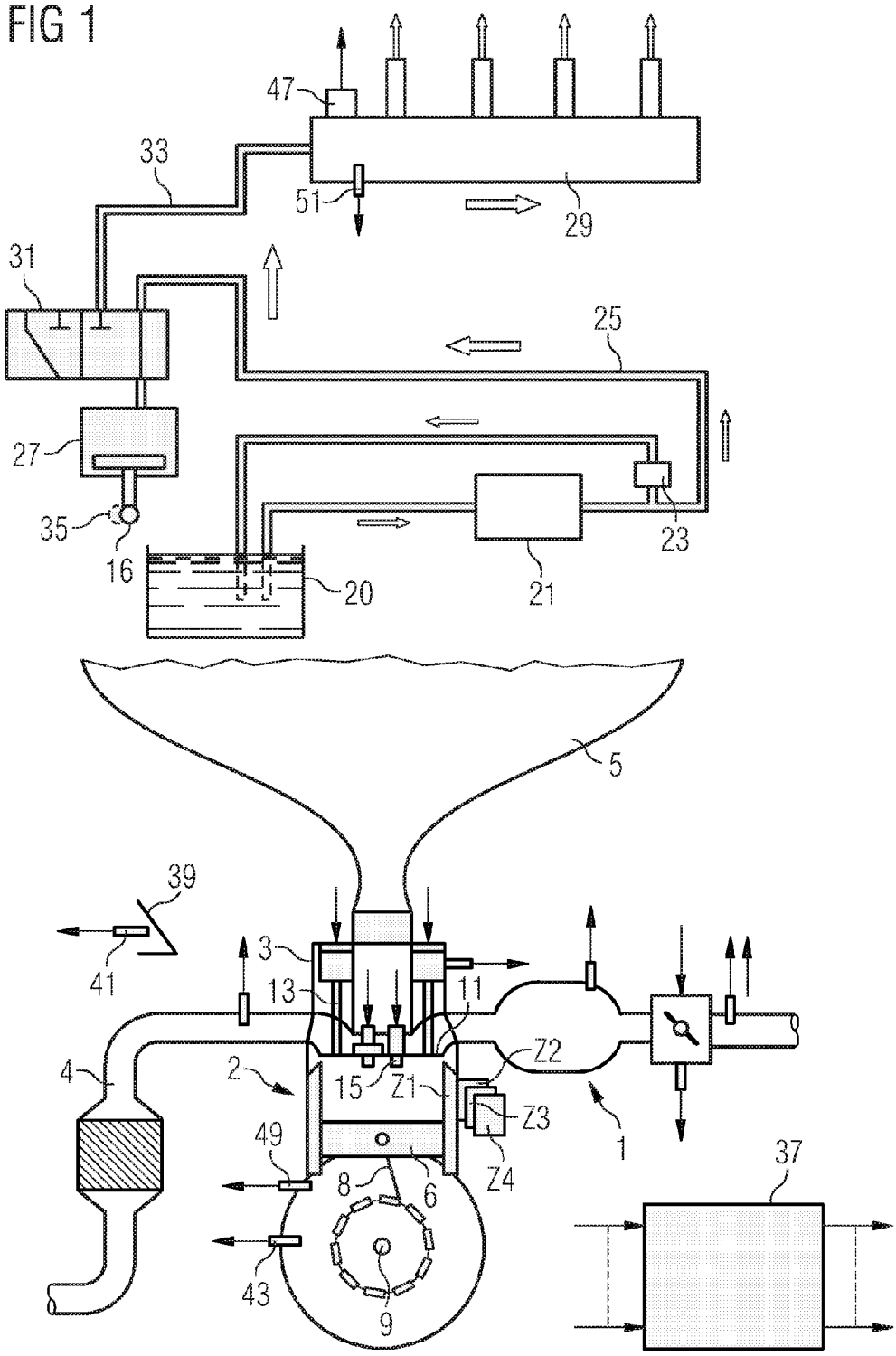
FIG. 1 shows an internal combustion engine with a control device.

According to various embodiments, in a method and a corresponding device for operating an internal combustion engine with a fuel pump, which on the drive side is coupled with a camshaft or a crankshaft, and a fuel accumulator, which is supplied by the fuel pump and to which a pressure sensor is assigned for sensing the pressure in the fuel accumulator, a first and a second crankshaft angle rotation are assigned to each cycle of the internal combustion engine. On internal combustion engines the camshaft is coupled with the crankshaft. Depending on a signal sequence of the pressure sensed in the fuel reservoir which is characteristic of the respective crankshaft rotation, it is ascertained whether the crankshaft is in its first or second rotation. In this way simple and reliable assignment of the respective first and second crankshaft rotation is possible and therefore also synchronization, which means that during further operation solely on the basis of preferably one measurement signal from a crankshaft angle sensor the respective crankshaft angle within the respective cycle and therefore also the first and also the second crankshaft rotation can be assigned.

In accordance with various embodiments, depending on the signal sequence of the sensed pressure a characteristic value is determined and depending on a comparison of the characteristic value with a specified threshold value it is ascertained whether the crankshaft is in its first or second rotation. This is particularly simple to implement.

The threshold value is determined depending on a variable which is characteristic of a fluid temperature. This makes it possible to ascertain particularly simply and particularly precisely whether the crankshaft is in its first crankshaft rotation or second crankshaft rotation.

This is particularly advantageous if either no crankshaft angle sensor is provided or if such is not available e.g. owing to failure. The process of sensing the pressure in the fuel reservoir includes in particular reading data into a computer or memory unit, in particular in connection with temporary storage of the data.

According to a further embodiment, the signal sequence of the sensed pressure in the fuel accumulator which is characteristic of the respective crankshaft rotation is sensed in order to ascertain whether the crankshaft is in its first or second rotation during an operating phase of the internal combustion engine in which an increase in pressure takes place in the fuel accumulator. In this operating phase it has been shown that the signal sequence of the sensed pressure in the fuel accumulator is particularly significantly characteristic with regard to ascertaining whether the first or second crankshaft rotation is taking place.

According to a further embodiment, the signal sequence of the sensed pressure in the fuel accumulator which is characteristic of the respective crankshaft rotation is sensed in order to ascertain whether the crankshaft is in its first or second rotation near to the time when the internal combustion engine is started. In this connection the knowledge is used that near to the time when the internal combustion engine is started, and especially in a start phase of the internal combustion engine, typically a big increase in pressure takes place in the fuel accumulator.

According to a further embodiment, at least in one cycle of the internal combustion engine the pressure in the fuel accumulator is decreased before the signal sequence of the sensed pressure in the fuel accumulator which is characteristic of the respective crankshaft rotation is sensed in order to ascertain whether the crankshaft is in its first or second rotation. This then provides potential for subsequently increasing the pressure which is accompanied by the side-effect of the particularly good significance of the characteristic of the signal sequence of the sensed pressure with regard to ascertaining whether the internal combustion engine is in the first or the second crankshaft rotation.

The at least one cycle in which the pressure is decreased must not necessarily directly adjoin the cycle in which the signal sequence of the sensed pressure in the fuel accumulator which is characteristic of the respective crankshaft rotation is sensed in order to ascertain whether the crankshaft is in its first or second rotation.

According to a further embodiment, before the signal sequence of the sensed pressure in the fuel accumulator which is characteristic of the respective crankshaft rotation is sensed in order to ascertain whether the crankshaft is in its first or second rotation an adjustment drive for adjusting a phase of the camshaft relative to the crankshaft is controlled into a reference position. This makes it possible to ascertain particularly simply and reliably, also on an internal combustion engine with adjustable phase, whether the crankshaft is in its first or second rotation.

According to a further embodiment, it is ascertained whether the crankshaft is in its first or second rotation within a specified crankshaft angle window relative to in each case one rotation of the crankshaft depending on the signal sequence of the sensed pressure in the fuel accumulator. This is particularly simple to implement.

According to a further embodiment, it is ascertained whether the crankshaft is in its first or second rotation by referring to a reference angle after a specified length of time within a specified time window relative to in each case one rotation of the crankshaft depending on the signal sequence of the sensed pressure in the fuel accumulator.

An internal combustion engine (FIG. 1) comprises an intake tract 1, an engine block 2, a cylinder head 3, an exhaust tract 4 and a fuel supply unit 5.

The engine block 2 comprises several cylinders Z1 to Z4 which have pistons 6 and connecting rods 8 by which they are coupled with a crankshaft 9.

The cylinder head 3 comprises a valve gear with a gas inlet valve 11 and a gas outlet valve 13. The gas inlet valve 11 and the gas outlet valve 13 are driven by a camshaft on which gas exchange valve cams 17 are configured which impact on the gas inlet valve 11 and the gas outlet valve 13. If appropriate, two camshafts can be provided with one assigned to the gas inlet valve 11 and the other to the gas outlet valve 13.

Figure 2:
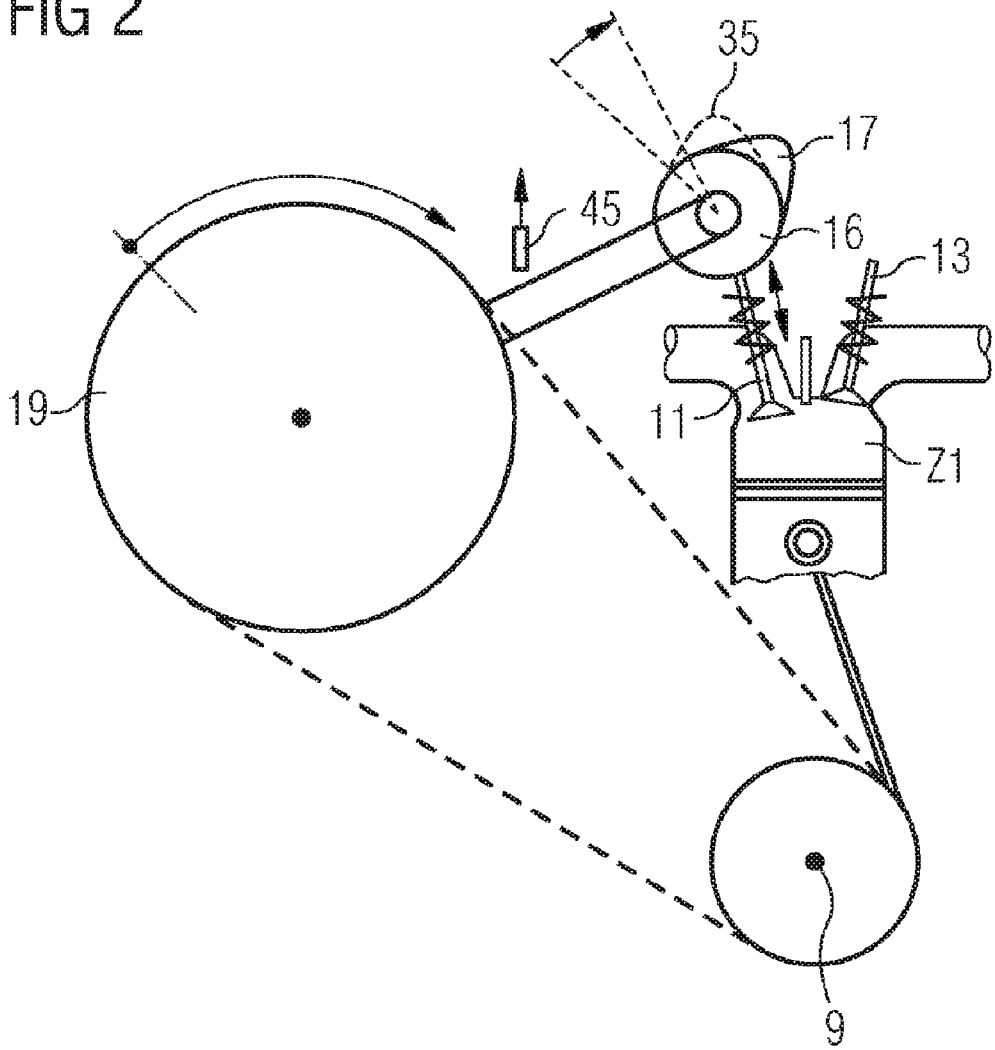
FIG. 2 shows a further view of elements of the internal combustion engine.

The drive for the gas inlet valve 11 and/or the gas outlet valve 13 can include in addition to camshaft 16 an adjustment device 19 which is coupled with camshaft 16 and with crankshaft 9. By means of the adjustment device 19 (FIG. 2) the phase between the crankshaft 9 and the camshaft 16 can be adjusted.

The cylinder head 3 further comprises an injection valve 15 and preferably a spark plug not designated further. The injection valve can alternatively be located in the intake tract 1.

The fuel supply unit 5 comprises a fuel tank 20 which is connected with a low-pressure pump 21 via a first fuel line. On the outlet side the low-pressure pump 21 is functionally connected to an inlet 25 of a high-pressure pump 27. Also on the outlet side the low-pressure pump 21 is provided with a mechanical regulator 23, which is connected on the output side with the tank via a further fuel line.

The mechanical regulator is preferably a simple spring-loaded valve in the type of a nonreturn valve, for which the spring constant is selected such that the pressure in the inlet 25 does not drop below a specified low pressure. The low-pressure pump 21 is preferably designed in such a way that during operation it always delivers a quantity of fuel which is high enough so that the pressure does not drop below the specified low pressure. The inlet 25 is conducted to a valve 31, which is configured as a 3/2-way valve.

In addition, a high-pressure pump 27 is provided which is configured as a reciprocating piston pump and which is connected with the valve 31. Also connected with valve 31 is an inlet 33 to a fuel accumulator 29. The high-pressure pump 27 therefore moves up and down cyclically with the rotation of the camshaft 16 and is driven by a pump cam 35 provided for this purpose. Depending on the design, the high-pressure pump 27 can comprise several cylinders, and preferably over the extent of the camshaft several, for example three, pump cams are arranged with the result that each cylinder of the high-pressure pump 27 performs a corresponding number of strokes during one rotation of the camshaft 16. The at least one pump cam 35 can also be located on the crankshaft 9 and the high-pressure pump can then be driven by the pump cam(s)35 located on the crankshaft 9.

In a first switch position of the valve 31 the high-pressure pump 27 is connected hydraulically with the inlet 25. During a suction movement of its piston it therefore sucks fuel from the inlet 25. During an expulsion stroke of its piston it presses the fuel back into the inlet 25 in this switch position.

In the second switch position of the valve 31 the high-pressure pump 27 is hydraulically connected with the inlet 33 to the fuel accumulator 29. The flow rate delivered by the high-pressure pump 27, i.e. the volume of fuel which is pumped during one cylinder segment period by the high-pressure pump 27 into the fuel accumulator 29 can be controlled by a switch signal which causes the switch position of valve 31 to change from the first to the second position or vice versa.

The flow rate of the pump can be adjusted in two different ways. Firstly, at the beginning of the expulsion cycle the high-pressure pump 27 can be coupled hydraulically with the inlet 33 to the fuel accumulator. The switch signal is then generated at the crankshaft angle which is expected to deliver the desired volume of fuel and then has the effect that from this point in time the high-pressure pump 27 is coupled hydraulically with the inlet 25. Alternatively, the flow rate can be controlled in that for a specifiable crankshaft angle the high-pressure pump 27 is hydraulically coupled with the inlet 25 after the expulsion stroke of the high-pressure pump 27 has started. The switch signal then causes the high-pressure pump 27 to be coupled via the valve 31 with the inlet 33 to the fuel accumulator 29.

The injection valves 15 are connected with the fuel accumulator 29. The fuel is thus supplied to the injection valves 15 via the fuel accumulator 29.

In addition, a control device 37 is provided, to which sensors are assigned which sense various measured variables and in each case determine the measurement value of the measured variable. Operating variables comprise variables derived from the measured variables. Depending on at least one of the operating variables the control device 37 determines actuating variables which are then converted into one or several actuating signals for controlling the actuators by means of corresponding actuator drives. The control device 37 can also be described as a device for operating the internal combustion engine. It comprises in particular corresponding input/output interfaces which for example comprise A/D converters and store corresponding data or also programs which can be constituent elements of a computer unit.

The sensors are a pedal sensor 41, which senses a pedal position of a gas pedal 39, a crankshaft angle sensor 43, which senses a crankshaft angle, a camshaft angle sensor 45, which senses a camshaft angle, and a fuel pressure sensor 47, which senses a pressure in the fuel accumulator 29. The measurement signal is assigned to a signal sequence P_F_S of the sensed pressure in the fuel accumulator 29. In addition, a first temperature sensor 49 is provided, which senses a coolant temperature of the internal combustion engine, and a second temperature sensor 51, which senses a fluid temperature TF in the fuel accumulator 29.

The crankshaft angle sensor 43 is preferably configured as an incremental sensor and preferably comprises a pickup wheel with teeth, in particular 58 teeth, and an extra-big gap at a crankshaft reference position L. A Hall-based sensor element is preferably provided as the sensor element. Depending on the measurement signal of the crankshaft angle sensor, the crankshaft reference position L, which can also be designated as a gap, can be particularly easily ascertained.

Depending on the configuration of the invention there can be fewer sensors than stated above or additional sensors can be fitted.

The actuators are for example a throttle valve, the gas inlet and gas outlet valves 11, 13, the injection valve 15, the spark plug or the valve 31. By means of the valve 31 a volume flow control of the fuel flowing into the fuel accumulator 29 can be achieved according to the mode of operation explained above in connection with the high-pressure fuel pump. A different volume flow control valve may, however, also be provided.

In addition to the cylinder Z1 described in detail, further cylinders Z2 to Z4 are usually present in the internal combustion engine, to which corresponding actuators or also sensors are assigned.

For operating the internal combustion engine, programs are stored in the control unit 37, which are executed in the control unit 37 during operation of the internal combustion engine.

Figure 3:
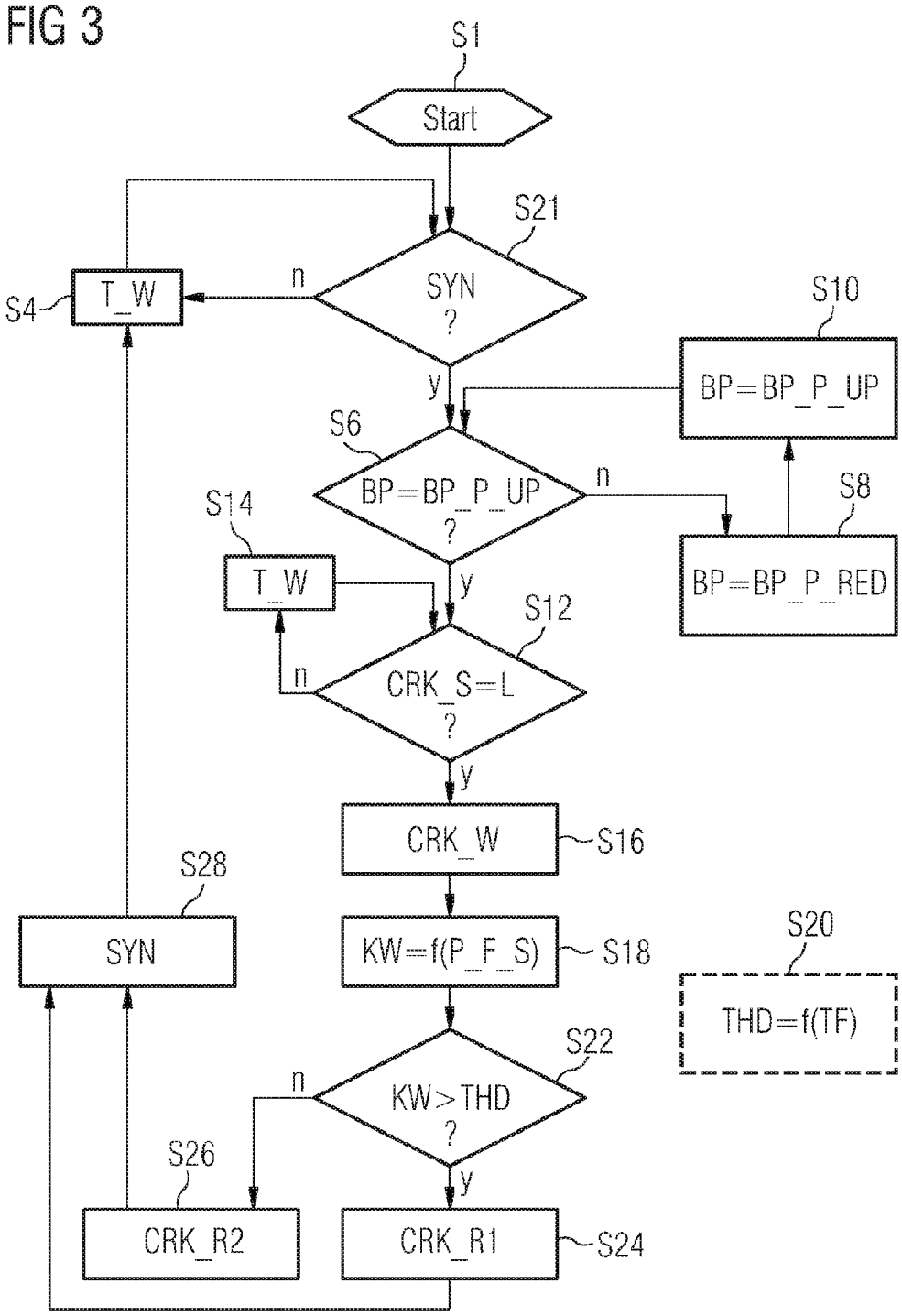
FIG. 3 shows a first flowchart of a program for operating the internal combustion engine.

A first program for operating the internal combustion engine is started in a step S1 (FIG. 3), in which variables may be initialized.

In a step S2 it is checked whether a synchronization SYN is necessary with regard to assignment, whether the crankshaft 39 is in a first crankshaft rotation CRK_R1 of the respective cycle or in a second crankshaft rotation CRK_R2 of the respective cycle. The first crankshaft rotation CRK_R1 can for example comprise the charge cycle top dead center. The second crankshaft rotation CRK_R2 can for example comprise the ignition top dead center.

If the condition of step S2 is not fulfilled, the program branches into a step S4, in which it preferably remains for a specified waiting time T_W before processing continues again in step S2. The specified waiting time can also be dependent on a rotation of the crankshaft 9 and can also be selected differently according to actual conditions.

If, however, the condition of step S2 is fulfilled, it is checked in a step S6 which operating phase BP the internal combustion engine is in, and whether it is in the operating phase BP_P_UP of pressure increase. This is preferably for example the case near to the time when the internal combustion engine is started, but can also be the case when the pressure increases further.

If the condition of step S6 is not fulfilled, a step S8 can preferably be executed, in which the operating phase BP is controlled into an operating phase BP_P_RED of pressure reduction, if the other requirements for controlling the internal combustion engine permit. In this way the pressure in the fuel accumulator 29 can be suitably reduced and in a step S10 then as operating phase BP controlled into the operating phase BP_P_UP of pressure increase. Processing then continues in step S6.

If, however, the condition of step S6 is fulfilled, it is checked in a step S12 whether on the basis of signal CRK_S from the crankshaft angle sensor 43 the crankshaft reference position L can be ascertained. If the condition of step S12 is not fulfilled, the program branches into step S14, in which it remains for the waiting time T_W, which can differ from that in step S4. Processing then continues again in step S12.

If, however, the condition of step S12 is fulfilled, the program remains in a step S16 until the beginning of a specified crankshaft angle window CRK_W is ascertained. Preferably the crankshaft angle window CRK_W is suitably specified in such a way that the signal sequence P_F_S of the sensed pressure in the fuel accumulator 29 differs in a characteristic way according to whether the crankshaft is in its first crankshaft rotation CRK_R1 or its second crankshaft rotation CRK_R2 of the respective cycle. The suitable width and position of the crankshaft angle window CRK_W is preferably determined suitably by tests and specified in advance.

In a step S18, during the crankshaft angle window CRK_W, the signal sequence P_F_S is sensed, i.e. in particular read in via an interface of the control device 37 and for example into the computer unit, which for example can comprise one or several registers or other memories. The signal sequence P_F_S is preferably at least temporarily stored in the control device 37 for further processing.

In addition in step S18 preferably a characteristic value KW is then determined depending on the previously sensed signal sequence P_F_S according to a calculation specification. Thus, for example a pressure increase taking place during the crankshaft angle window CRK_W, i.e. a corresponding pressure differential, can be determined as the characteristic value.

Preferably a step S20 is then executed in which a threshold value THD is determined depending on the fluid temperature 29 in the fuel accumulator or a variable that is representative for it. A corresponding characteristic map can preferably be used for this purpose.

Next it is checked in a step S22 whether the characteristic value KW is greater than the specified threshold value THD. If this is the case the crankshaft is ascertained to be in the first rotation CRK_R1 of the respective cycle. If this is not the case, however, the crankshaft is ascertained to be in the second rotation CRK_R2 during the respective cycle. Depending on the configuration of the calculation specification for the characteristic value the assignment can be the other way round.

Next preferably a step S28 is executed in which a synchronization SYN takes place which for example can consist in that a corresponding meter reading or other information status is updated so that in the following cycles it can be ascertained which crankshaft rotation crankshaft 9 is performing solely on the basis of the sequence of the measurement signal from the crankshaft angle sensor.

Processing then continues again in step S4.

Figure 4:
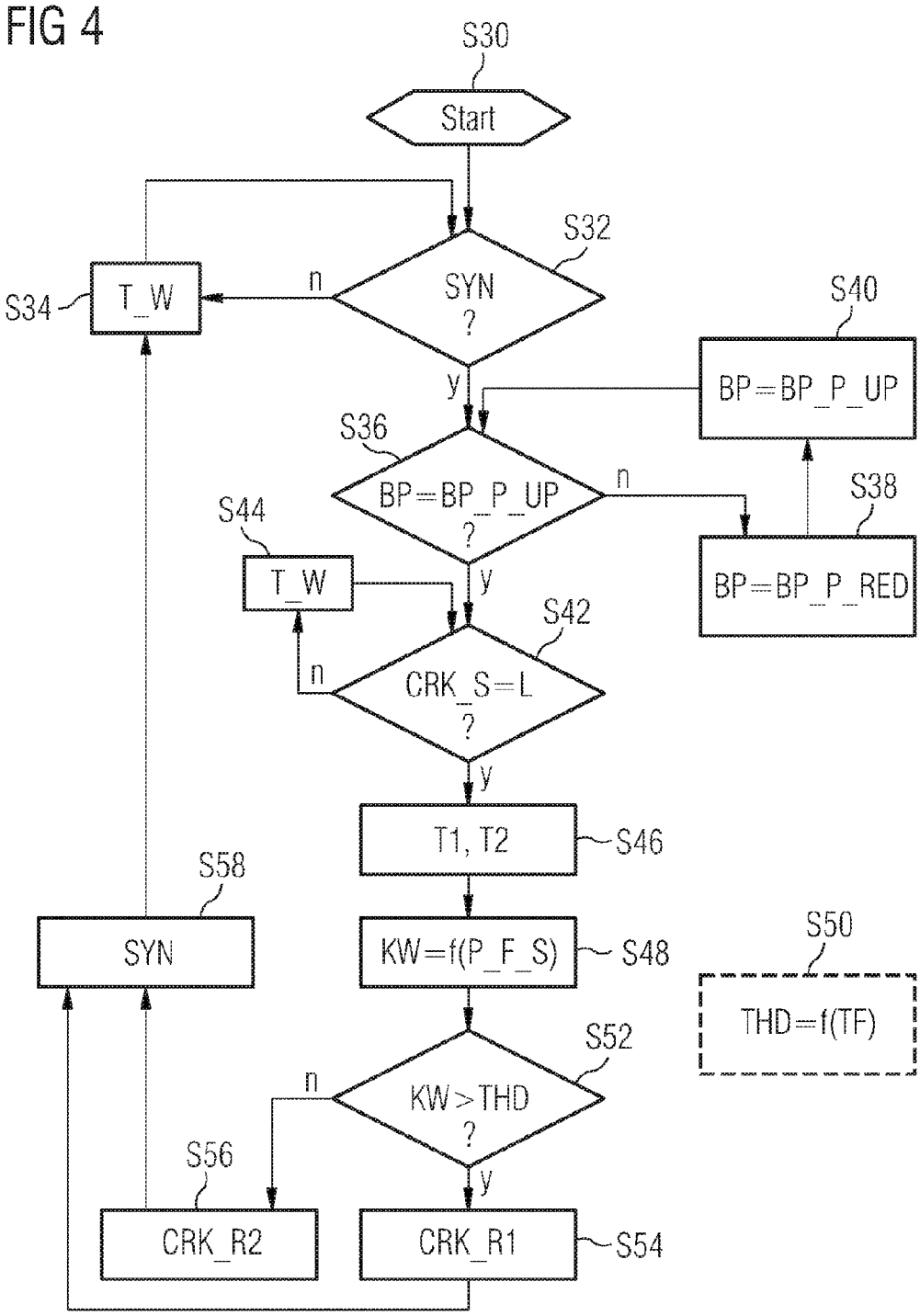
FIG. 4 shows a second flowchart of a program for operating the internal combustion engine.

FIG. 4 shows a further configuration of a program for operating the internal combustion engine. The steps S30 to S42 correspond to steps Si to S12 of the program in accordance with FIG. 3. A step S46 differs from step S16 in that the program initially remains static for a specified first period of time T1 before the signal sequence P_F_S is sensed within a second period of time T2 in a step S48, which otherwise corresponds to step S18. The steps S50 to S58 then correspond again to the steps S20 to S28.

Figure 5:
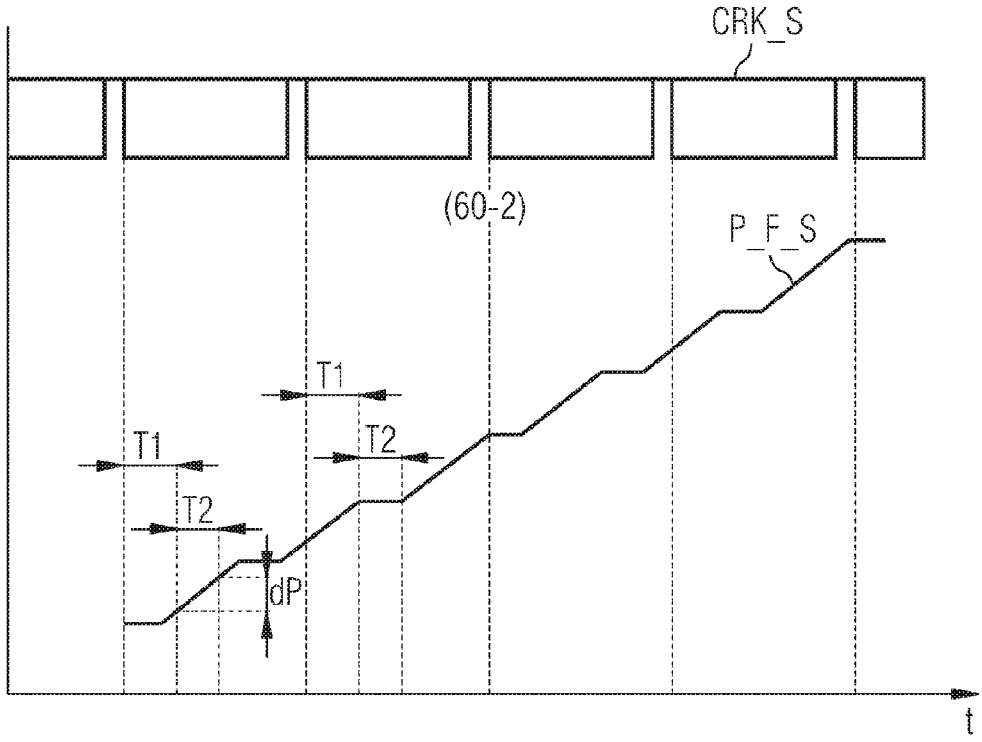
FIG. 5 shows signal sequences.

A FIG. 5 shows a sequence of the crankshaft angle CRK_S and the corresponding crankshaft reference positions L plotted over the time t. In addition, the signal sequence $P_p$_F_S of the sensed pressure in the fuel accumulator 29 is likewise plotted over time, whereby the first and second periods of time T1, T2 are shown by way of example for consecutive crankshaft rotations. dP designates a sensed increase in pressure.

What is claimed is:

1. A method for operating an internal combustion engine with a fuel pump, which on the drive side is coupled with a camshaft or a crankshaft, and a fuel accumulator, which is supplied by the fuel pump and to which a pressure sensor is assigned for sensing the pressure in the fuel accumulator, whereby each cycle of the internal combustion engine is assigned a first and a second crankshaft rotation, the method comprising the step of:

depending on a signal sequence of the sensed pressure in the fuel accumulator which is characteristic of the respective crankshaft rotation ascertaining whether the crankshaft is in its first or second rotation, wherein a threshold value is determined depending on a variable which is characteristic of a fluid temperature, depending on the signal sequence, determining a characteristic value, and depending on a comparison of a characteristic value with the specified threshold value, ascertaining whether the crankshaft is in its first or second rotation.

2. The method according to claim 1, wherein the signal sequence of the sensed pressure in the fuel accumulator which is characteristic of the respective crankshaft rotation is sensed in order to ascertain whether the crankshaft is in its first or second rotation while an operating phase of the internal combustion engine takes place in which the pressure in the fuel accumulator increases.

3. The method according to claim 1, wherein the signal sequence of the sensed pressure in the fuel accumulator which is characteristic of the respective crankshaft rotation is sensed in order to ascertain whether the crankshaft is in its first or second rotation near to the time when the internal combustion engine is started.

4. The method according to claim 1, wherein, in at least one cycle of the internal combustion engine, before the signal sequence of the sensed pressure in the fuel accumulator which is characteristic of the respective crankshaft rotation is sensed in order to ascertain whether the crankshaft is in its first or second rotation the pressure in the fuel accumulator is reduced.

5. The method according to claim 1, wherein before the signal sequence of the sensed pressure in the fuel accumulator which is characteristic of the respective crankshaft rotation is sensed in order to ascertain whether the crankshaft is in its first or second rotation an adjustment drive for adjusting a phase of the camshaft relative to the crankshaft is controlled into a reference position.

6. The method according to claim 1, wherein within a specified crankshaft angle window relative to in each case one rotation of the crankshaft depending on the signal sequence of the sensed pressure in the fuel accumulator it is ascertained whether the crankshaft is in its first or second rotation.

7. The method according to claim 1, wherein by referring to a reference angle after a specified period of time within a specified time window relative to in each case one rotation of the crankshaft depending on the signal sequence of the sensed pressure in the fuel accumulator it is ascertained whether the crankshaft is in its first or second rotation.

8. A device for operating an internal combustion engine with a fuel pump, which on the drive side is coupled with a camshaft or a crankshaft, and a fuel accumulator, which is supplied by the fuel pump and to which a pressure sensor is assigned for sensing the pressure in the fuel accumulator, wherein to each cycle of the internal combustion engine a first and a second crankshaft rotation is assigned, the device being operable to determine a threshold value depending on a variable which is characteristic of a fluid temperature, determine a characteristic value depending on a signal sequence of the sensed pressure in the fuel accumulator which is characteristic of the respective crankshaft rotation, ascertain whether a crankshaft is in its first or second rotation depending on a comparison of the characteristic value with the specified threshold value, and to ascertain whether the crankshaft is in its first or second rotation depending on a signal sequence of the sensed pressure in the fuel accumulator which is characteristic of the respective crankshaft rotation.

9. The device according to claim 8, wherein the device is operable to sense the signal sequence of the sensed pressure in the fuel accumulator which is characteristic of the respective crankshaft rotation in order to ascertain whether the crankshaft is in its first or second rotation while an operating phase of the internal combustion engine takes place in which the pressure in the fuel accumulator increases.

10. The device according to claim 8, wherein the device is operable to sense the signal sequence of the sensed pressure in the fuel accumulator which is characteristic of the respective crankshaft rotation in order to ascertain whether the crankshaft is in its first or second rotation near to the time when the internal combustion engine is started.

11. The device according to claim 8, wherein, in at least one cycle of the internal combustion engine, before the signal sequence of the sensed pressure in the fuel accumulator which is characteristic of the respective crankshaft rotation is sensed in order to ascertain whether the crankshaft is in its first or second rotation the device is operable to reduce the pressure in the fuel accumulator.

12. The device according to claim 8, wherein before the signal sequence of the sensed pressure in the fuel accumulator which is characteristic of the respective crankshaft rotation is sensed in order to ascertain whether the crankshaft is in its first or second rotation the device is operable to control an adjustment drive for adjusting a phase of the camshaft relative to the crankshaft into a reference position.

13. The device according to claim 8, wherein within a specified crankshaft angle window relative to in each case one rotation of the crankshaft depending on the signal sequence of the sensed pressure in the fuel accumulator the device is operable to ascertain whether the crankshaft is in its first or second rotation.

14. The device according to claim 8, wherein by referring to a reference angle after a specified period of time within a specified time window relative to in each case one rotation of the crankshaft depending on the signal sequence of the sensed pressure in the fuel accumulator the device is operable to ascertain whether the crankshaft is in its first or second rotation.

15. A method for operating an internal combustion engine with a fuel pump, which on the drive side is coupled with a camshaft or a crankshaft, and a fuel accumulator, which is supplied by the fuel pump and to which a pressure sensor is assigned, wherein each cycle of the internal combustion engine is assigned a first and a second crankshaft rotation, the method comprising the step of:

sensing a pressure in the fuel accumulator, depending on a signal sequence of the sensed pressure, ascertaining whether the crankshaft is in its first or second rotation, determining a threshold value depending on a variable which is characteristic of a fluid temperature, depending on the signal sequence, determining a characteristic value, depending on a comparison of a characteristic value with the specified threshold value, determining whether the crankshaft is in its first or second rotation;

controlling said combustion engine using said crankshaft determination.

16. The method according to claim 15, wherein the signal sequence of the sensed pressure is sensed while an operating phase of the internal combustion engine takes place in which the pressure in the fuel accumulator increases.

17. The method according to claim 15, wherein the signal sequence of the sensed pressure is sensed near to the time when the internal combustion engine is started.

18. The method according to claim 15, wherein, in at least one cycle of the internal combustion engine, before the signal sequence of the sensed pressure is sensed the pressure in the fuel accumulator is reduced.

19. The method according to claim 15, wherein before the signal sequence of the sensed pressure is sensed an adjustment drive for adjusting a phase of the camshaft relative to the crankshaft is controlled into a reference position.

20. The method according to claim 15, wherein within a specified crankshaft angle window relative to in each case one rotation of the crankshaft depending on the signal sequence of the sensed pressure, ascertaining whether the crankshaft is in its first or second rotation.

* * * * *